United States Patent [19]

Borst

[11] Patent Number: 4,986,438

[45] Date of Patent: Jan. 22, 1991

[54] RECLOSEABLE NESTING TAB CONTAINER

[75] Inventor: Rodney D. Borst, Oregon, Wis.

[73] Assignee: Placon Corporation, Madison, Wis.

[21] Appl. No.: 504,316

[22] Filed: Apr. 3, 1990

[51] Int. Cl.[5] ..... B65D 45/00

[52] U.S. Cl. ..... 220/315; 220/324; 220/339; 229/2.5 R

[58] Field of Search ..... 220/315, 324, 339; 229/2.5 R

[56] References Cited

U.S. PATENT DOCUMENTS

| | | | |
|---|---|---|---|
| 3,351,270 | 11/1967 | Hoohjec | 220/339 |
| 3,767,110 | 10/1973 | Congleton | 220/324 X |
| 3,977,595 | 8/1976 | Hillgenberg | 229/2.5 R X |
| 4,079,880 | 3/1978 | Edwards | 220/315 X |
| 4,169,531 | 10/1979 | Wood | 206/531 |
| 4,202,464 | 5/1980 | Mohs et al. | 220/339 |
| 4,212,415 | 7/1980 | Neely | 220/324 X |
| 4,471,881 | 9/1984 | Foster | 220/339 |
| 4,602,719 | 7/1986 | Borst | 220/263 |
| 4,687,129 | 8/1987 | Cugley | 229/44 R |
| 4,892,220 | 1/1990 | Foos | 229/2.5 R X |
| 4,917,261 | 4/1990 | Borst | 229/2.5 R X |

OTHER PUBLICATIONS

Placon Corporation, Thermoformed Package Drawings, Exhibits A, B, C.

*Primary Examiner*—Steven M. Pollard
*Attorney, Agent, or Firm*—Lathrop & Clark

[57] ABSTRACT

A flexible reclosable thermoformed thermoplastic container is disclosed which has a base with side walls and a peripheral shoulder extending from the side walls which has a downwardly depending rim. The cover of the container has peripheral edges with depending side walls and is preferably attached by an integral hinge to the base. The cover is adapted to close upon and cover the base. A locking tab with two opposed faces spaced to fit between the base rim and side walls is connected by an integral hinge to the cover. The locking tab of the cover may be rotated about the integral hinge and inserted between the side wall and rim wall of the base to close the container. Containers with depressions in the base or cover side walls to facilitate opening are also disclosed. Containers may have two locking tabs connected on opposite sides of the cover by integral hinges which permit the cover to be removed entirely from the container. By providing unclasped cover portions on such a container, a self-venting container may be formed. By providing a ridge on the base beneath the locking tab, the cover may be fixably attached to the base.

9 Claims, 9 Drawing Sheets

RECLOSEABLE NESTING TAB CONTAINER

FIELD OF THE INVENTION

This invention relates to reclosable containers in general, and to thermoformed containers with tab closing mechanisms in particular.

BACKGROUND OF THE INVENTION

Reclosable containers are convenient and easily loadable packages which are advantageously used when it is desired to repeatedly access a product within a container, or more commonly when a package with a positive locking closure is needed which may be easily loaded and sealed without the need for adhesives or sealing tools. These containers are commonly thermoformed of thin thermoplastic material and have a bottom portion or base and a top lid or cover. To keep the container closed after initial opening, it is necessary to provide some means of interlocking the cover and the base. A common type of interlocking structure employs projections and depressions on shoulders extending from the cover and base which engage with each other in a "snap" fit. The cover and the base are thus held together during normal usage but may be pulled apart by applying sufficient force.

To avoid unwanted opening of the container, it is advantageous to have a tight seal between the cover and the base. However, if the seal is too tight it will require excessive force to reopen the container. This difficulty in opening is compounded by the fact that with a standard snap fit closure the separating force must be applied by pulling the top cover and base in opposite directions. With containers that are too large or too small to be easily grasped, even greater difficulties in opening will be encountered.

The problem of producing a container with a tight reliable seal, yet that is easy to open, is long standing in the art and has evoked many different approaches to solution. What is needed is an easily manufactured package that may be securely closed yet easily opened.

SUMMARY OF THE INVENTION

A reclosable nesting tab container of this invention has a base with upwardly extending side walls which have an outwardly extending peripheral shoulder with a downwardly depending rim wall. The cover of the container has a top with downwardly extending side walls and is adapted to close upon and cover the base. A locking tab is attached by an integral hinge to a cover side wall so that when the cover is folded down to cover the base the locking tab may be rotated about the integral hinge and inserted between a base side wall and the base rim wall to retain the cover closed on the base. The cover side walls are preferably substantially the same depth as the base rim wall so that the top of the cover is adjacent the base peripheral shoulder when the cover is closed on the base. The locking tab has two opposed faces which are spaced to fit between the base side wall and the base rim wall. In a preferred form the base side walls are inclined away from the peripheral shoulder and the base rim wall is inclined away from the base side walls and the two opposed faces of the locking tab incline towards one another. A depression may be provided in the side wall of the container adjacent the inserted locking tab to permit a human finger to be inserted behind the locking tab so that the front part of the finger may push outwardly on the locking tab and the back part of the finger may push against the cover to dislodge the locking tab. A further alternative embodiment is a container with locking tabs attached by integral hinges to opposite sides of a cover so that the cover may be removed from the base. A further embodiment has a ledge formed on a wall of the base substantially parallel to the peripheral shoulder of the base and located a distance from the shoulder so as to engage and hold a locking tab inserted between the side wall and the base rim wall with the base flange of the tab on the ledge so that the cover will remain attached to the base when the cover is in either an open or closed position. Another embodiment has unclasped portions between two opposed locking tabs such that an increase of pressure within the container beyond a predetermined limit will cause the cover to lift from the base in selected portions to permit the venting of pressurized gases.

It is an object of this invention to provide a container with a snug nesting closure.

It is also an object of this invention to provide a container that has a tight seal yet which is easy to open.

It is a further object of the present invention to provide a container which may be opened with one hand.

It is an additional object of the present invention to provide a container with a detachable cover that will vent pressurized interior gases at elevated temperatures.

It is a still further object of the present invention to provide a container with a resealable independent cover that is detachably hinged to the base.

It is yet a further object of the present invention to provide a secure closure for a very flexible container.

It is yet another object of the present invention to provide a plastic container which will retain its seal at elevated or reduced temperatures.

These objects and others will become apparent from the following detailed description taken in conjunction with the accompanying drawings showing a preferred embodiment of the invention for exemplification.

DESCRIPTION OF THE PREFERRED EMBODIMENTS

Figure 1:
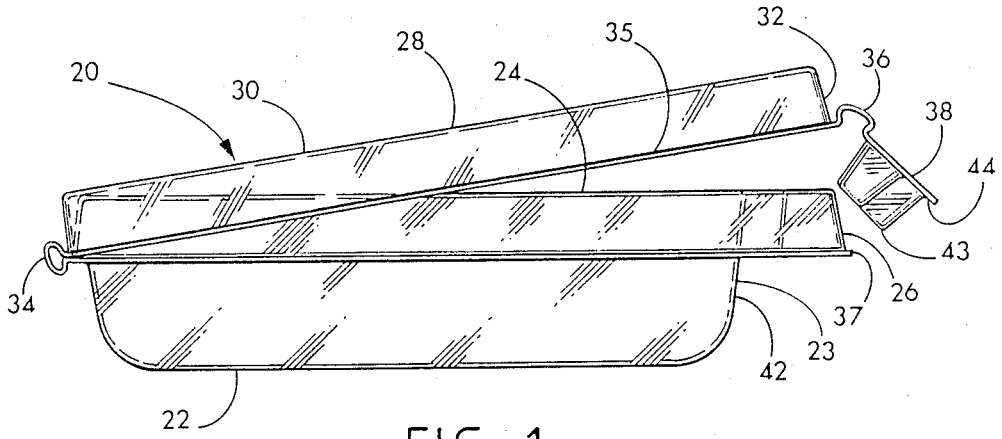
FIG. 1 is a side view of a reclosable container of this invention showing the cover in an open position with the locking tab unengaged.

Referring more particularly to FIGS. 1-18 wherein like numbers refer to similar parts, one preferred embodiment of the closure of this invention is the container 20, shown in FIGS. 1-5. The container 20 is preferably thermoformed from a single sheet of thin, somewhat flexible, thermoplastic material and has a base 22 with upwardly extending base side walls 23. A peripheral shoulder 24 extends outwardly from the base side walls. A base rim wall 26 depends downwardly from the peripheral shoulder 24. The base side walls and the base rim wall are inclined so that the walls are closest to one another at the peripheral shoulder. The container 20 has a cover 28 which is adapted to close upon and cover the base 22. The cover has a top 30 from which depend the cover side walls 32. The cover side walls 32 are substantially the same depth as the base rim wall 26. The cover 28 is attached to the base 22 by an integral hinge 34. Typically, as a result of the molding process the cover 28 will have a flange 35 extending outwardly from the cover side walls 32 and the base 22 will have a flange 37 extending outwardly from the base rim wall 26. The flanges 35, 37 will generally be very narrow. A locking tab 38 is attached to the cover 28 by a second integral hinge 36.

Figure 2:
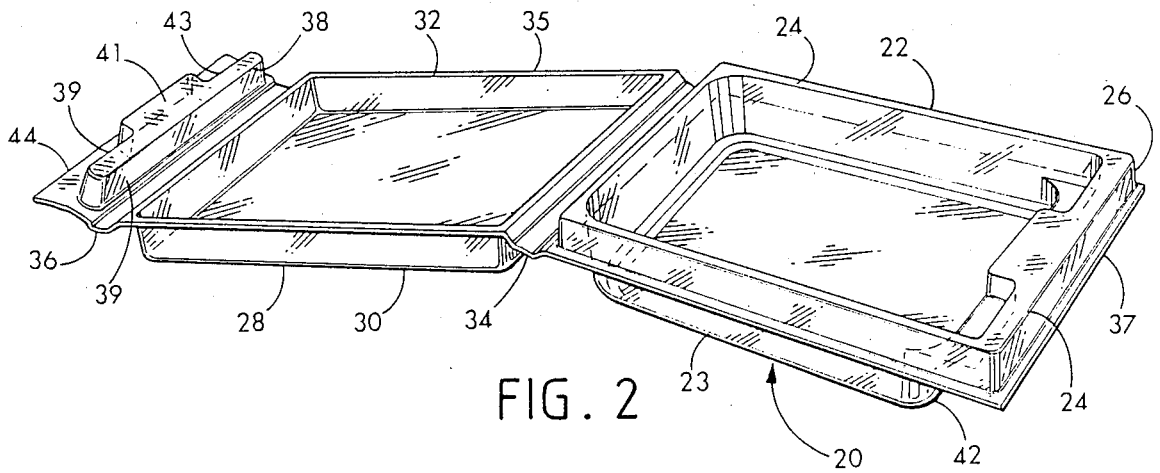
FIG. 2 is a perspective view of the container of FIG. 1 in a fully open position.
Figure 4:
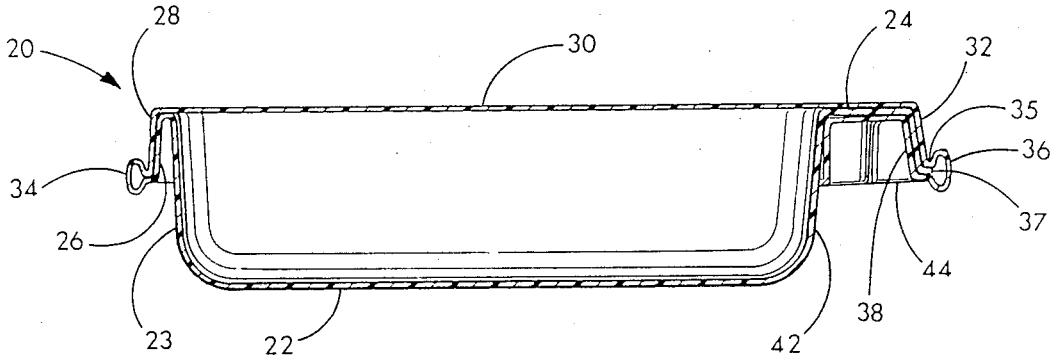
FIG. 4 is a cross-sectional view of the container of FIG. 3 taken along section line 4—4.
Figure 5:
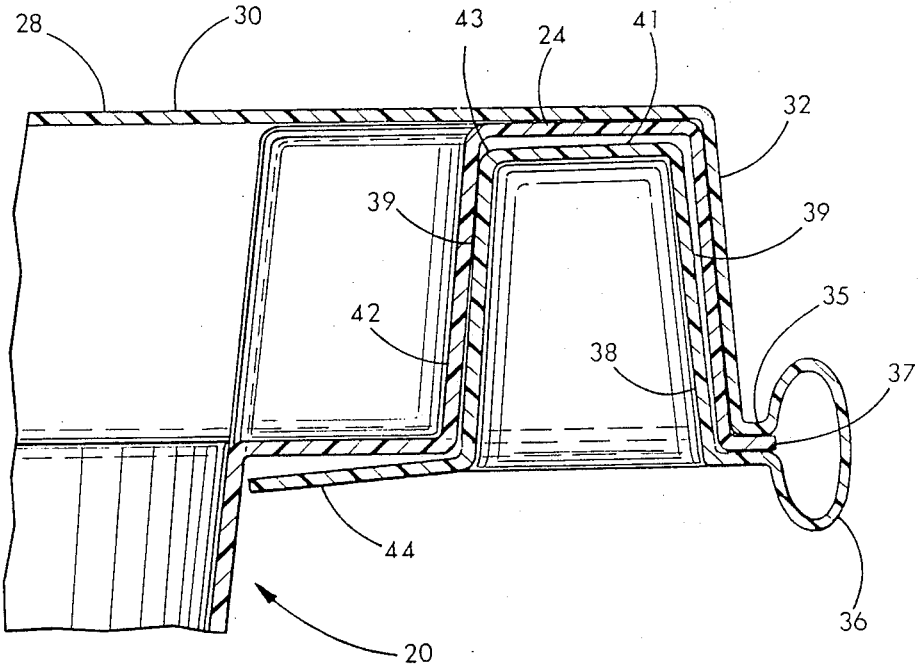
FIG. 5 is an enlarged fragmentary cross-sectional view of the closed container of FIG. 3 taken along section line 5—5 and showing the triple-nesting closure.

The locking tab 38 has two opposed faces 39 which are spaced from one another a sufficient distance so that the tab may fit between the front base side wall 42 and the base rim wall 26. The faces 39 of the locking tab 38 preferably incline towards one another to facilitate insertion of the locking tab 38 beneath the rim wall 26 and peripheral shoulder 24 and between the front side wall 42 and the rim wall 26 of the base 22. The base front side wall 42 may be a varying distance from the rim wall 26 as seen in FIGS. 4 and 5. The locking tab 38 also has a tab flange 44 which extends outwardly from the faces of the tab to provide a portion of the tab for gripping or dislodging by a user's fingers. As best seen in FIG. 2, the distance between the opposed faces 39 may vary to conform to the varying distance between the front base side wall 42 and the base rim wall 26. In the container 20, the tab faces 39 are farther apart in the center of the tab, as shown in FIG. 4, than on the sides of the tab, as shown in FIG. 5.

Figure 3:
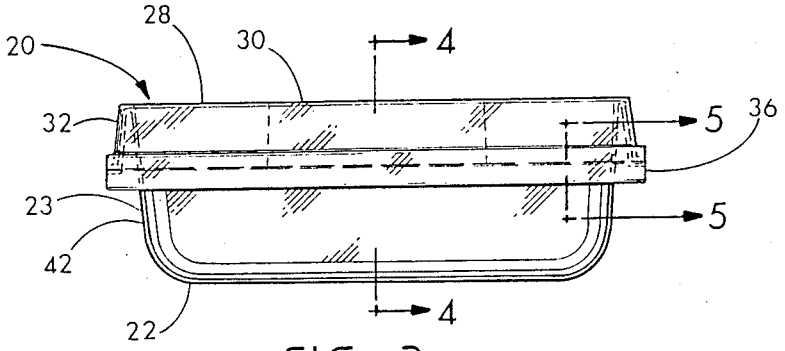
FIG. 3 is a front view of the container of FIG. 1 in a closed position.

To close the container 20 of FIG. 2, the cover 28 is folded to fit over the base 22, as in FIGS. 3, 4 and 5 so the cover side walls 32 cover the base rim wall 26 and the top 30 rests upon or is closely spaced from the base peripheral shoulder 24. To secure the closed container, the locking tab 38 is rotated about the integral hinge 36 and inserted between the front base side wall 42 and the base rim wall 26. Where the faces 39 of the locking tab 38 are joined to the generally planar tab top 41, there are linear edges, which will tend to be areas of greater rigidity on the locking tab 38. The inner tab edge 43 makes contact with the front base side wall 42 in the process of inserting and removing the locking tab and contributes to the temporary elastic deformation of the front base side wall 42 when the locking tab is rotated into a clasping position. When the locking tab 38 is secured between the front base side wall 42 and the base rim wall 26 the container is held closed. The tab 38 is prevented from pivoting about a hinge point defined by the hinge 36 by the front base side wall 42 which blocks the tab 38 from rotating and unclasping the container 20. The front base side wall 42 is at an angle to the path of rotation of the inner tab edge 43 and restricts the tendency of the tab 38 and hinge 36 to elastically return to the original unclasped position.

To open the container 20 a user grasps the flange 44 of the locking tab 38 and pulls downwardly, rotating the tab outwardly about the integral hinge 36 and elastically deforming the front base side wall 42 until the locking tab 38 is removed from between the front base side wall 42 and the base rim wall 26 and the cover 28 is unclasped from the base 22.

As best seen in FIG. 5, a very tight seal on the container 20 is secured by the interlocking action of the locking tab 38, the front side wall 42, peripheral shoulder 24, and rim wall 26 of the base, and the top 30 and side wall 32 of the cover 28 which together form a triple-nesting seal. The locking tab may be made to any desired length or depth to provide the desired clasping strength. Preferably, the side walls 32 of the cover and the rim wall 26 of the base will surround the entire container providing an overall tight seal.

The container is opened by rotating the locking tab 38 about the integral hinge 36. If desired, the container may be opened with one hand by grasping the locking tab flange 44 on either side of the locking tab 38 with the thumb and second finger and then pushing with the index finger against the front base wall 42.

In referring to FIG. 5 it can be seen that a triple-nesting of plastic elements is present in the container closure.

Figure 6:
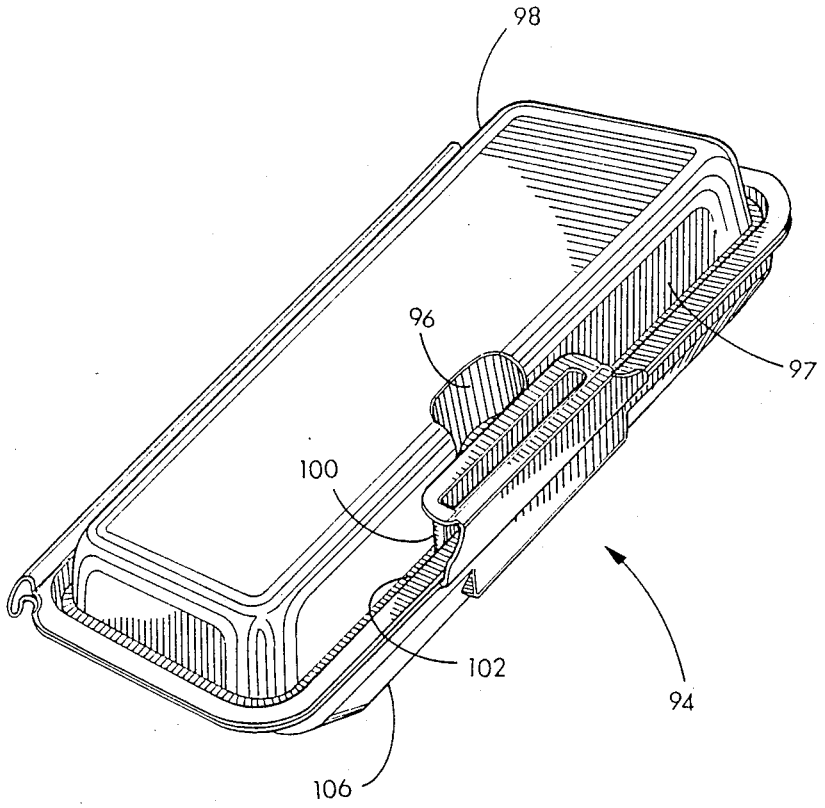
FIG. 6 is a top perspective view of an inverted container of this invention in a closed position having a depression on the base side wall.

To further facilitate opening of the containers embodying this invention, especially to increase the ease of one-handed opening, a depression may be provided in the wall of the container adjacent the clasped locking tab. FIG. 6 shows a container 94 generally similar to the container 20, but with portions defining a depression 96 in the base side wall 97 of the base 98 adjacent to the locking tab 100 inserted between the base side wall and the base rim wall 102. The container 94 is shown inverted to expose the clasped locking tab to view. This position of the container may be advantageous for making the clasping mechanism apparent to a first-time user.

To open container 94 with one hand, the index finger is inserted into the depression 96 with the front part of the index finger against the clasped locking tab 100, and the thumb is braced against the cover 106. The front part of the index finger exerts a dislodging force on the locking tab 100 while the back of the index finger exerts a reaction force on the base front side wall 97. By providing depressions 82 and 96, opening of the containers 46, 94 may also be facilitated with two hands, or with other combinations of fingers, as suits an individual user's needs.

Figure 7:
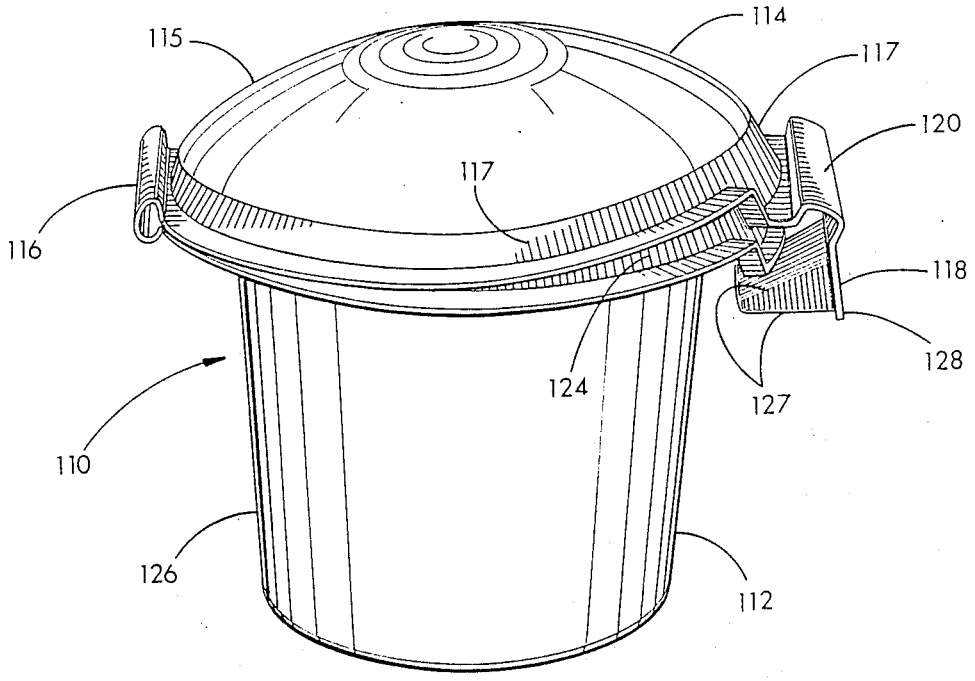
FIG. 7 is a side view of a cup-shaped container of this invention in an unclasped open position.
Figure 8:
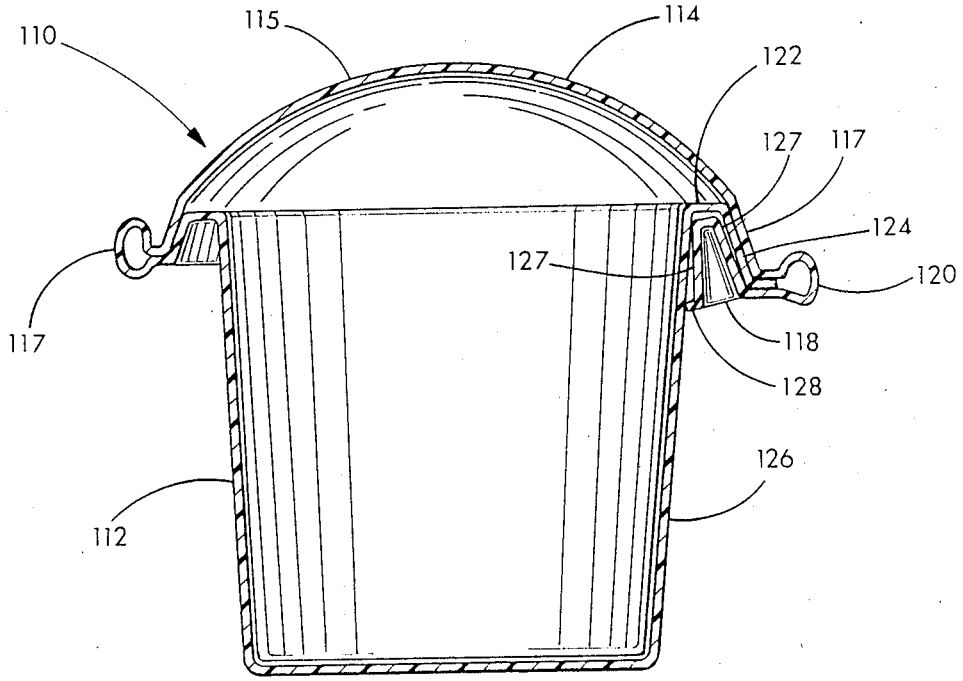
FIG. 8 is a cross-sectional view of the cup-shaped container of FIG. 7 in a closed position

The nesting closure of this invention may be utilized in conjunction with containers of widely varying shape. FIGS. 7 and 8 show an embodiment of this invention which is a substantially cup-shaped container 110. The base 112 of the container 110 is cup-shaped with a frustoconical side wall 126. The base side wall 126 has an outwardly extending annular peripheral shoulder 122 from which depends a rim wall 124 with a substantially frustoconical surface. A cover 114, which has a top 115 which is a section of a spherical surface with depending side walls 117, is attached to the base 112 by an integral hinge 116. Opposite the integral hinge 116, a locking tab 118 is joined to the cover 114 by the integral hinge 120. The locking tab 118 has opposed faces 127 which are spaced from one another so as to fit between the rim wall 124 and the side wall 126. The faces 127 of the locking tab 118 are frustoconical surface segments. The locking tab 118 also has a flange 128 by which it may be grasped. To close the container 110, the locking tab 118 is rotated about the integral hinge 120 and is inserted between the rim wall 124 and the base side wall 126. As best shown in FIG. 8, it is not necessary for the locking tab 118 to fit snugly between the base rim and side walls 124, 126 to securely close and clasp the container 110, so long as the tab is restrained from unclasping by the proximity of the base side wall 126.

Figure 9:
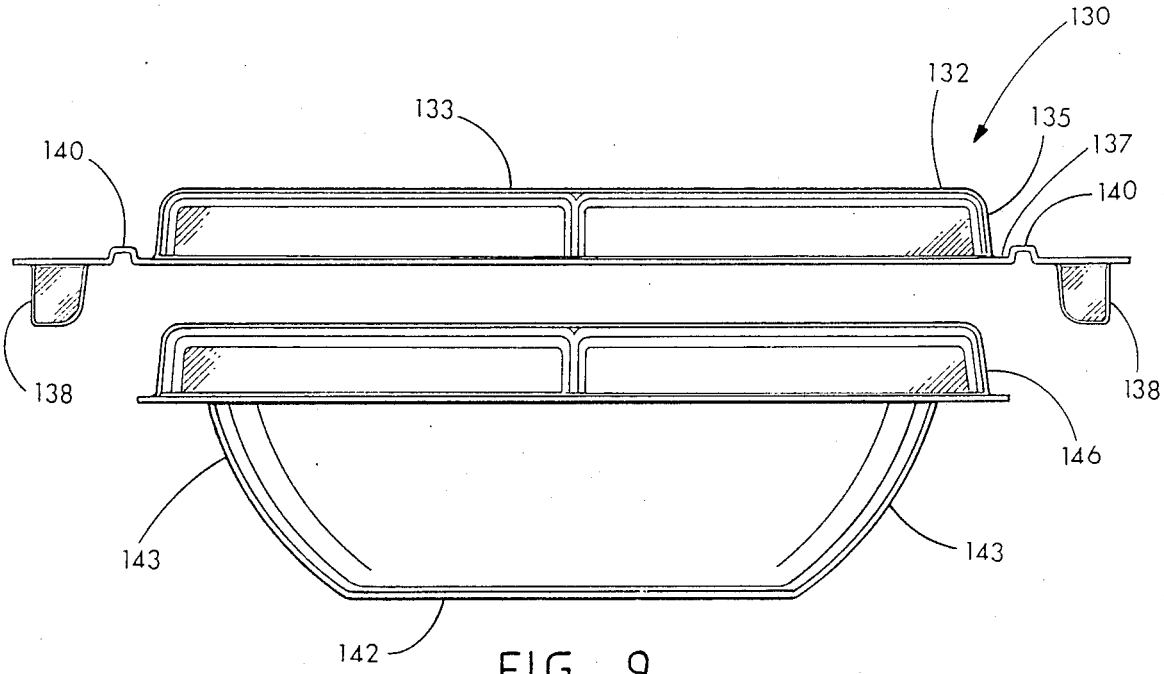
FIG. 9 is an exploded side view of a self-venting container of this invention having two locking tabs on a detachable cover.
Figure 10:
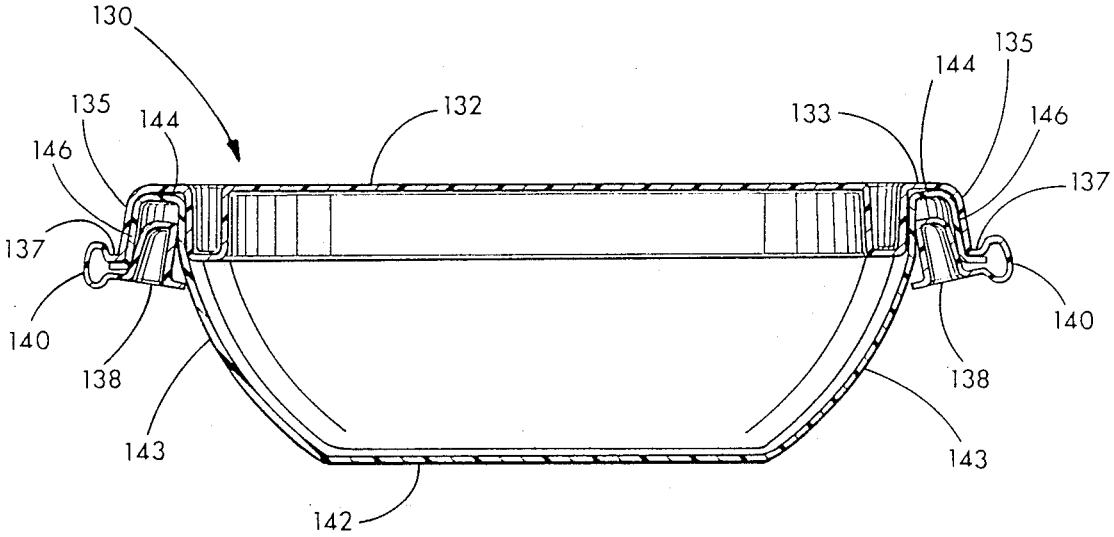
FIG. 10 is a cross-sectional view of the container of FIG. 9 in a closed position.
Figure 11:
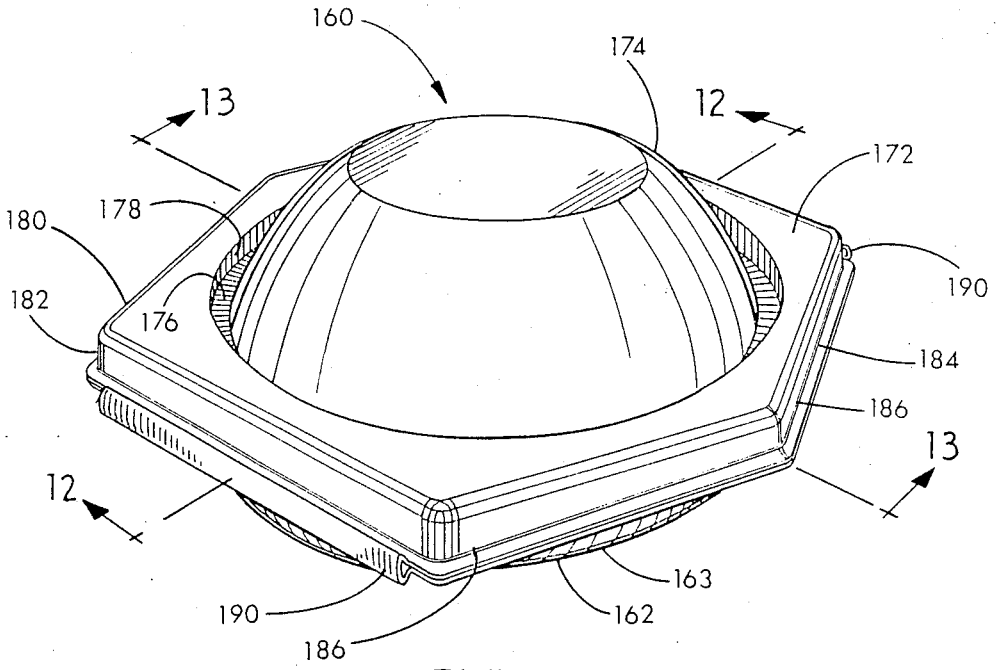
FIG. 11 is an isometric view of another self-venting container of this invention.

Another embodiment of this invention is shown in FIGS. 9 and 10. A twin locking tab container 130 has a cover 132 with a top 133 having downwardly depending side walls 135 with a narrow outwardly extending flange 137. Two locking tabs 138 are connected on opposite sides of the cover 132 at the flange 137 by integral hinges 140. A bowl-shaped base 142 has upwardly extending side walls 143 with an outwardly extending peripheral shoulder 144 from which depends a base rim wall 146. An additional seal may be given to the container 130 by providing a circular channel 145 in the top 133 of the cover 132. The channel fits within the side walls 143 of the bowl-shaped base 142.

To seal the container 130 the locking tabs 138 are rotated about the integral hinges 140 and inserted between the rim wall 146 and the side walls 143 on opposite sides of the base 142. The container 130 may be opened by unclasping both locking tabs 138 and lifting the cover 132 entirely clear of the base 142.

A container having locking tabs on opposed ends such as the container 130 may also have self-venting features. A self-venting container may have a flat top as does the container 130, or it may have a domed top to contain contents which may project above the base as shown in the self-venting container 160 of FIGS. 11–14.

The self-venting container 160 has a base 162 with a roughly bowl-shaped portion 163 which has an outwardly extending planar peripheral shoulder 164 which has a hexagonal perimeter. Base locking walls 166 depend from the peripheral shoulder 164 on opposite sides of the base 162. The base locking walls 166 are joined to one another by the base venting walls 168 which also depend from the peripheral shoulder 164 and which are comprised of two angled segments 170. The cover 172 of the self-venting container 160 has a central domed portion 174 which is substantially hemispherical. The bowl-shaped portion 174 has an outwardly extending circular lip 176. A cylindrical wall 178 extends upwardly from the lip 176 and is adapted to fit snugly within the bowl-shaped portion 163 of the base 162. A cover peripheral shoulder 180 of substantially the same plan as the base peripheral shoulder 164 extends outwardly from the cylindrical wall 178. Cover locking walls 182 depend from the cover peripheral shoulder 180 on opposite sides of the cover 172. The cover locking walls 182 are joined by cover venting walls 184 which are each formed of two angled segments 186. Locking tabs 188 are connected to the cover locking walls 182 by integral hinges 190.

Figure 12:
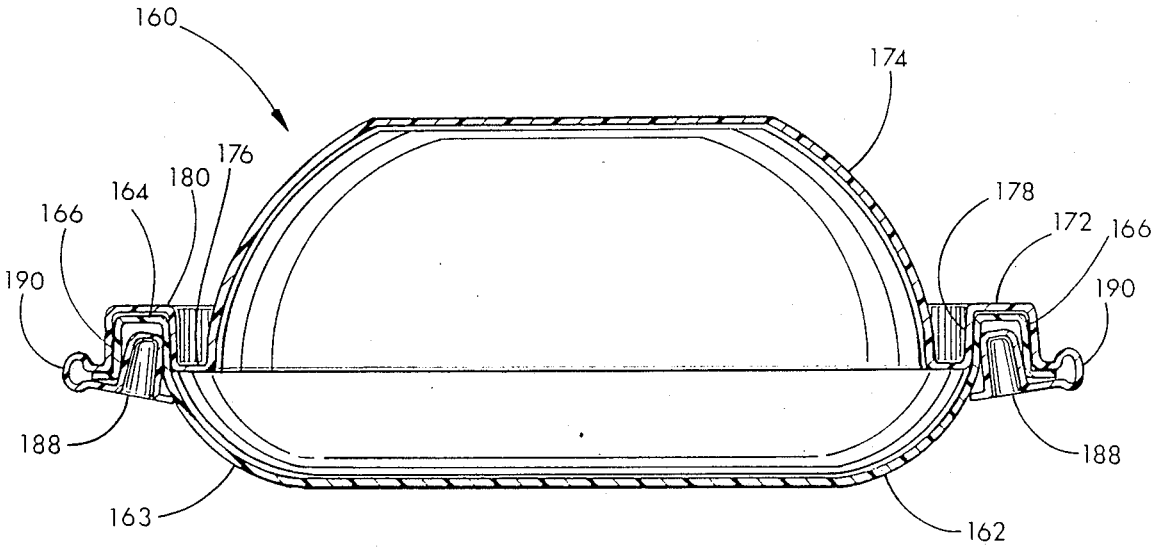
FIG. 12 is a cross-sectional view of the container of FIG. 11 taken along section line 12—12.
Figure 13:
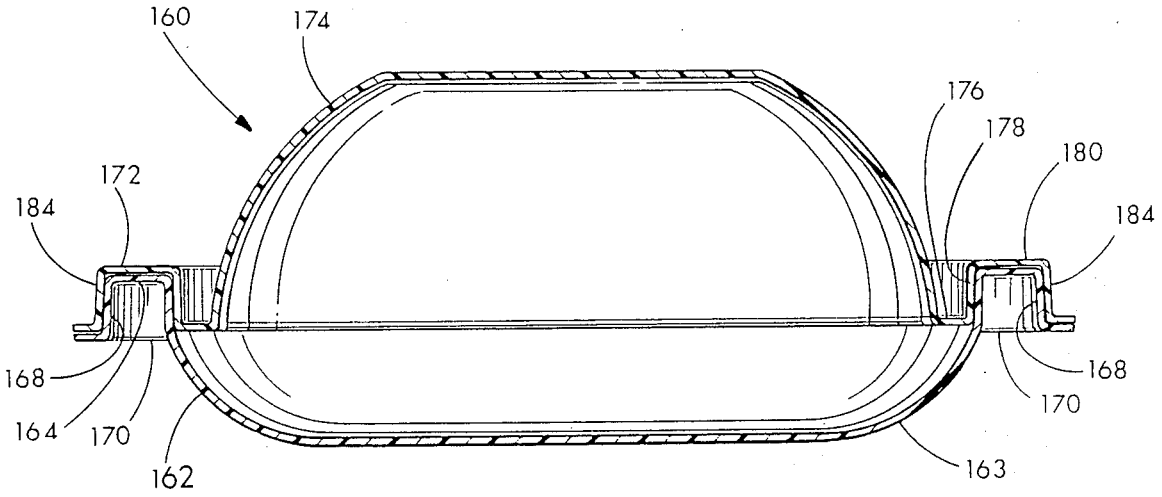
FIG. 13 is a cross-sectional view of the container of FIG. 11 taken along section line 13—13.

The cover 172 is adapted to fit snugly upon the base 162. When the cover is fitted to the base the locking tabs 188 may be rotated about the integral hinges 190 and locked between the exterior surface of the bowl-shaped base portion 163 and the base locking walls 166 as best shown in FIG. 12. The cover venting walls 184, however, are not directly clasped to the base 162. When the self-venting container 160 is in this closed configuration shown in FIGS. 11–13, it is a substantially vapor-tight container.

A typical plastic which will endure heating and microwave exposure such as polypropylene, will generally experience reduced stiffness at elevated temperatures. Reduced stiffness of the plastic from which the container 160 is formed will not significantly affect the reliability of the seal of the cover 172 to the base 162 provided by the locking tabs 188. Likewise, the altered plastic properties brought about by freezing or refrigerating the container 160 should not appreciably affect the closure.

The container 160 may be filled with wholly or partially liquid contents 192 such as soup. When the container 160 and contents 192 are heated, as for example in a microwave oven, heated vapor will be retained within the container by the tight seal provided by the locking tabs 188. In this way, desirable vapors may be retained within the contents 192. After prolonged heating, however, the liquid contents 192 will tend to build up an excessive pressure within the container which, if unrelieved, would burst the container and spill the contents. This undesirable effect is avoided due to the self-venting features of the container 160. As the pressure within the container increases over atmospheric pressure, a force is evenly applied over the interior surface of the container. The force is shown diagrammatically in FIG. 14 by the arrows 194. This force will tend to raise the domed cover portion 174 as well as the cover peripheral shoulder 180 and the cover venting walls 184. The ends of the cover will not be raised because the cover locking walls 182 are securely attached to the base 162 by the locking tabs 188.

Figure 14:
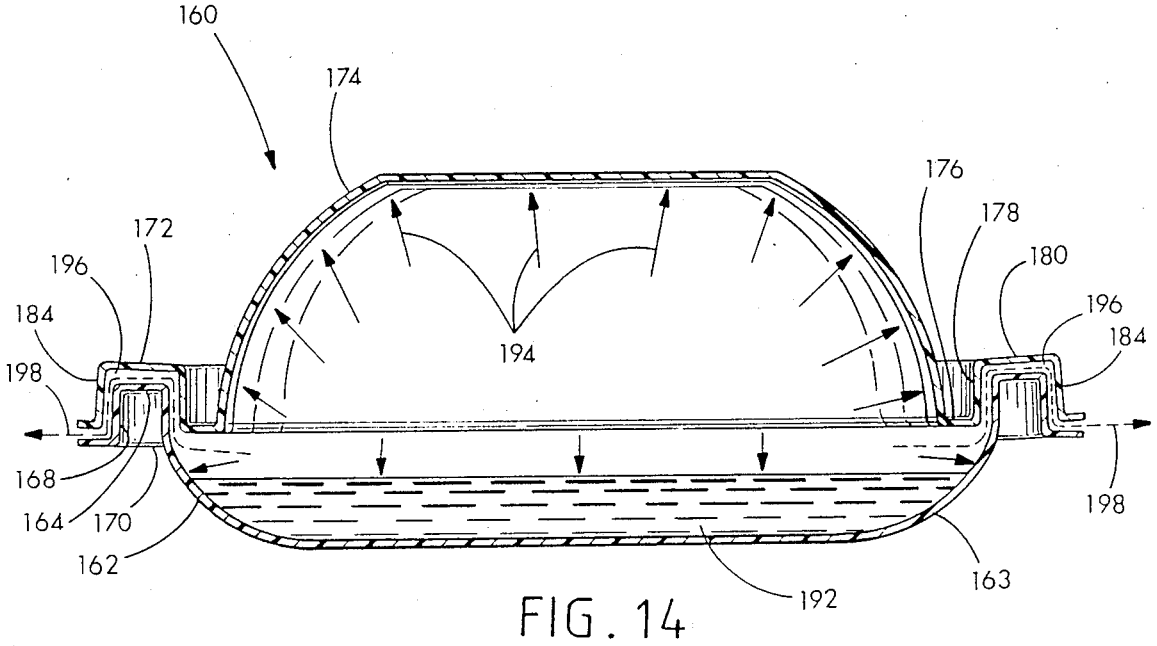
FIG. 14 is a cross-sectional view of the container of FIG. 11 with arrows showing the movement of gases in the venting mode.

The flexibility and dimensions of the container 160 may be chosen so that at a selected pressure the cover 172 will separate from the base to create venting channels 196. Pressurized gases may escape through the venting channels 196 and are represented in FIG. 14 by broken arrows 198. Once sufficient pressurized gases have left the container the forces acting to separate the base from the cover will decrease and the venting channels 196 will close. In this way only so much of the contents 192 is lost as is necessary to retain a sufficiently low pressure within the container 160.

It is important to note that a self-venting container need not have a domed cover, so long as the central portion of the cover is free to lift from the base when elevated interior pressures are generated.

Figure 15:
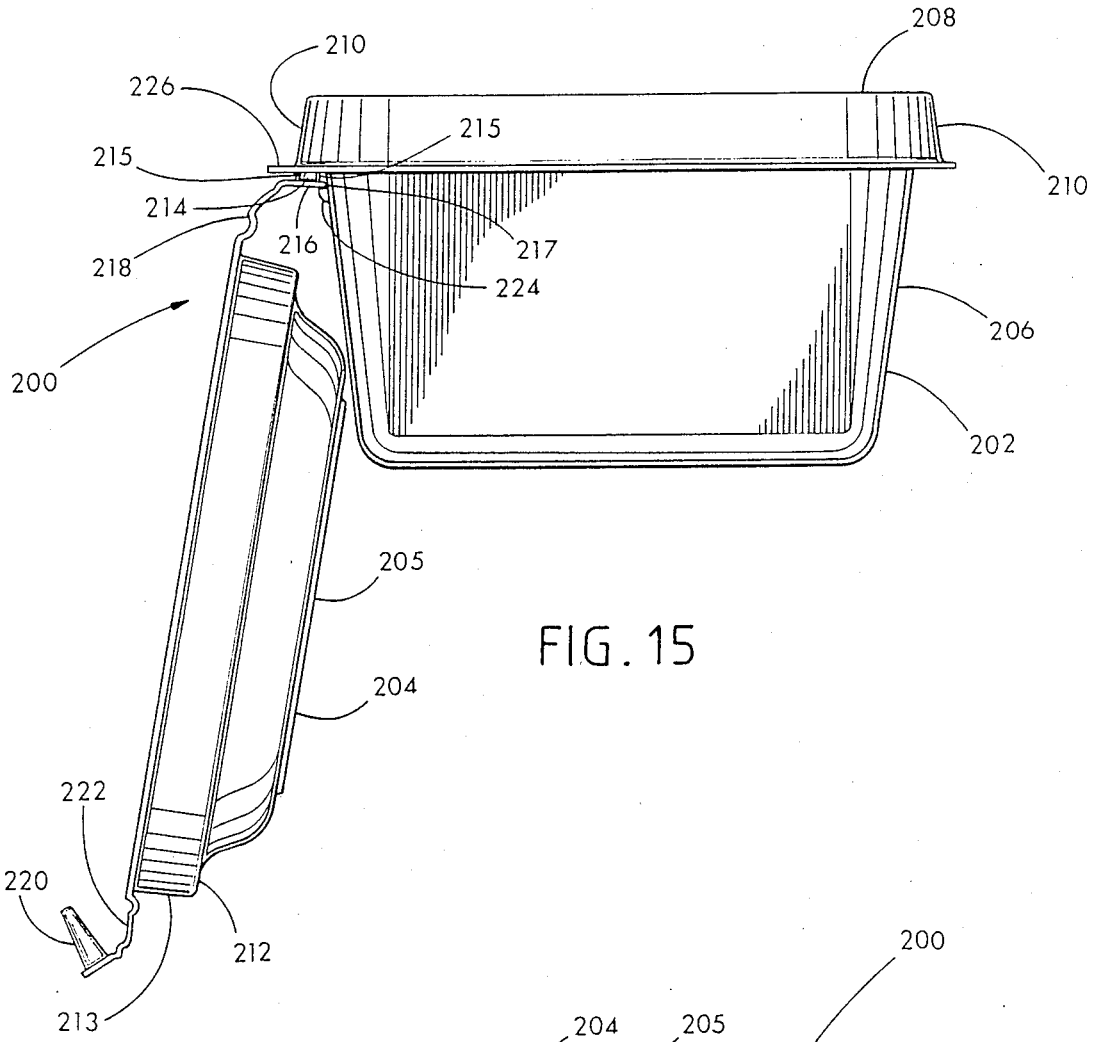
FIG. 15 is a side view of a two-piece container of this invention having a ledge for retaining a separate hinged cover in an open position.
Figure 16:
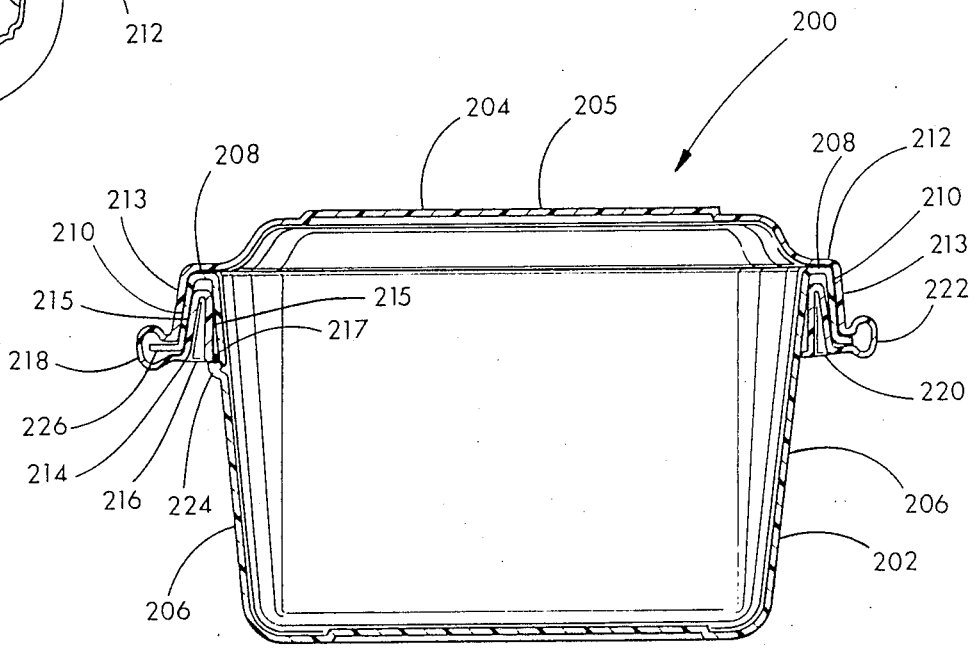
FIG. 16 is a cross-sectional view of the container of FIG. 15 in a closed position.

The tab closure of this invention may also be used to hingedly attach a cover to a base as in the two-piece container 200 shown in FIGS. 15 and 16. This embodiment of the invention has a base 202 and a cover 204 which is formed independently of the base. The base has side walls 206 with a peripheral shoulder 208 extending from the side walls and a rim wall 210 which depends from the peripheral shoulder 208. The cover 204 is adapted to fit over and cover the base 202. The cover has a top 205 with outwardly extending shoulder portions 212 adapted to overlie the peripheral shoulder 208 of the base. Side walls 213 depend from the cover shoulder portions 212 and when the cover is closed on the base snugly surround the rim wall 210 of the base 202. A locking tab 214 with inclined sides 215 which taper outwardly toward a base 216 and an outwardly extending flange 217 is connected at the flange 217 by an integral hinge 218 to one of the side walls 213 of the cover. A second locking tab 220 may be provided on a side wall 213 opposite the first locking tab 214 and may be connected to the cover 204 by an integral hinge 222. The cover 204 in this respect is generally similar to the cover 132 of the twin locking tab container 130. The base 202 of the container 200, however, is provided with a ledge 224 on the side wall 206 where it is desired to hingedly attach the cover 204 to the base 202. The ledge is formed integrally in the base side wall 206 and runs substantially parallel to the peripheral shoulder 208 of the base. The ledge 224 may be a depression or cutaway in the base side wall 206 but is preferably a linear wedge-shaped protrusion as best seen in FIG. 16. The ledge 224 is located a distance from the shoulder 208 so that when the locking tab 214 is inserted between the side wall 206 and the base rim wall 210 with the flange 217 of the locking tab 214 engaged on the ledge the cover 204 will remain attached to the base 202 when the cover is in either an open position as shown in FIG. 15 or in a closed position as shown in FIG. 16.

The ledge 224 braces the flange 217 of the locking tab 214 and prevents the locking tab 214 from dropping out from beneath the rim wall 210. The flange 217 is generally very narrow. A hinge stiffening member 226 may be provided on the rim wall 210 of the base 202. The hinge stiffening member 226 projects outwardly from the rim wall 210 above the ledge 224 and fits within the integral hinge 218 when the cover 204 is attached by the locking tab 214 to the base 202. The stiffening member 226 prevents undesired compression of the integral hinge 218 and aids the hinge 218 in retaining its original shape.

The ledge 224 permits the easy insertion of the locking tab 214 beneath the rim wall 210 yet retains the locking tab 214 therein until the tab is purposely removed. The second locking tab 220 may be inserted beneath the rim wall 210 opposite the first locking tab 214 as shown in FIG. 16 to effectively seal and close the container 200.

Figure 17:
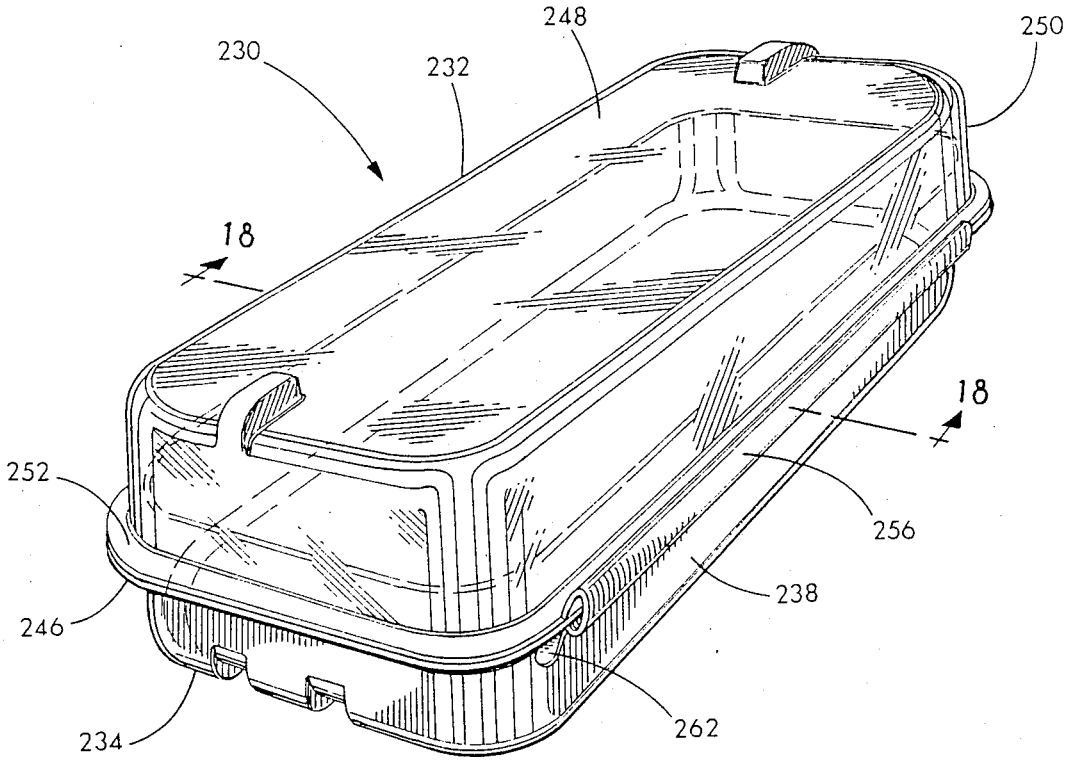
FIG. 17 is an isometric view of a clam shell package of this invention having a double-nesting closure.
Figure 18:
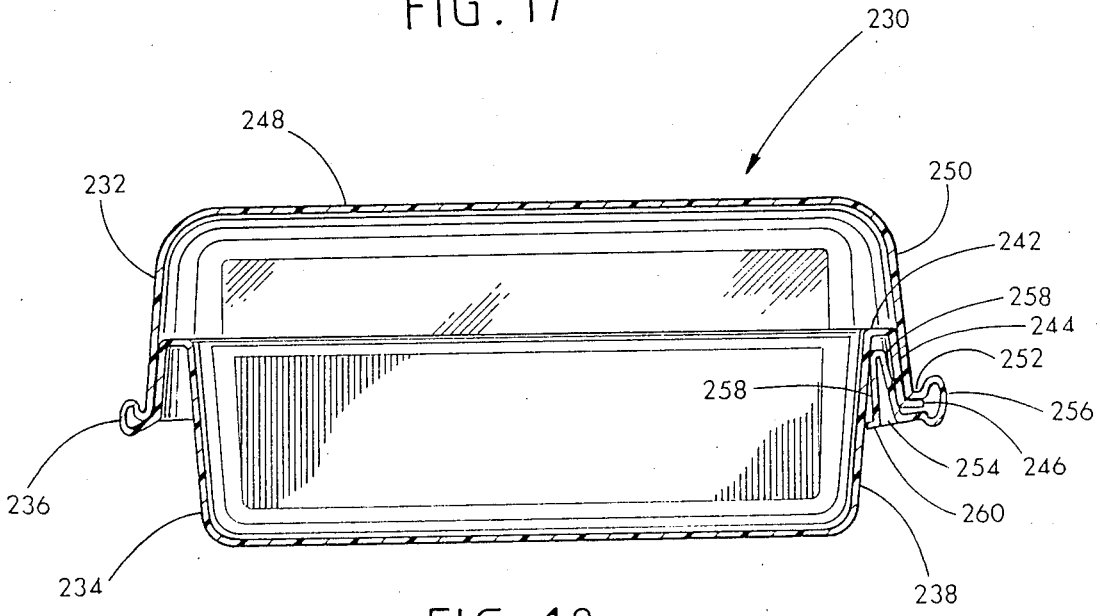
FIG. 18 is a cross-sectional view of the package of FIG. 17 taken along section line 18—18.

FIGS. 17 and 18 show a container 230 with a double-nesting embodiment of the closure of this invention. The container 230 has a cover 232 joined to a base 234 by an integral hinge 236. This thermoformed package may be formed of transparent plastic as shown. The base 234 has upwardly extending side walls 238 from which a peripheral shoulder 242 extends outwardly. A rim wall 244 extends downwardly from the peripheral shoulder 242 and terminates in a flange 246. The cover has a top 248 with depending side walls 250 which end in a flange 252. An integral hinge 236 connects the flange 252 of the cover 232 to the flange 246 of the base rim wall 244. A locking tab 254 is connected opposite the integral hinge 236 by a second integral hinge 256 to the cover flange 252. The locking tab 254 has two inclined faces 258 ending in a tab flange 260. Wing flaps 262 extends on either side of the tab flange 260. The locking tab 254 is adapted to rotate about the second integral hinge 256 and fit between the rim wall 244 and the side wall 238 of the base 234 to snugly close the cover 232 on the base 234.

As best shown in FIG. 18 the locking tab 254 is retained against the side wall 238 of the base 234. Unlike in the triple-nesting closure of FIG. 5, the top 248 of cover 232 does not lie adjacent to the peripheral shoulder 242 of the base 234. The double-nesting closure of container 230 may be used with containers having covers of significant depth.

Although the closure of this invention may be used with containers made from a variety of materials, it is particularly adapted to containers made of plastics which can be thermoformed from a single sheet of plastic stock material. Suitable initial plastic stocks include polypropylene, polyethylene, high impact polystyrene, polyester, polyvinyl chloride, acrylic copolymers and others. Typical sheet thicknesses for plastic containers may be utilized in accordance with the invention, for example, in the 12 to 30 thousandths of an inch range.

Many other containers embodying this invention may be formed having widely varied cover and base shapes, be it rectangular, circular, sperical, or any other form. Furthermore, the container may have one or more double-or triple-nesting closures on any or all sides of the container. Also, the cross section and plan of the locking tab can be varied widely and still perform the same locking function. In addition to the methods for opening the containers of this invention discussed herein, many other ways of opening are possible, each suited to the inclinantions of a particular user.

It should be understood that this invention is not limited to the particular construction and arrangement of parts herein illustrated and described, but embodies all such modified forms as come within the scope of the following claims.

What is claimed is:

1. A flexible reclosable thermoformed thermoplastic container comprising:

(a) a base having upwardly extending side walls, with a peripheral shoulder extending outwardly from the side walls and a rim wall depending downwardly from the shoulder;

(b) a cover having a top with downwardly extending side walls, the cover being adapted to close upon and cover the base; and (c) a locking tab having two spaced opposed faces and attached by an integral hinge to a cover side wall so that when the cover is folded down to cover the base, the locking tab may be rotated about the integral hinge and inserted in an upward direction toward the peripheral shoulder to fit snugly between a base side wall and the base rim wall to retain the cover closed on the base.

2. The container of claim 1 wherein the cover side walls are substantially the same depth as the base rim wall so that the top of the cover is adjacent the base peripheral shoulder when the cover is closed on the base.

3. The container of claim 1 wherein the cover is attached to the base by an integral hinge connecting the a cover side wall to the base rim wall.

4. The container of claim 1 wherein the base side walls are inclined and the base rim wall is inclined so that the base side walls are closest to the base rim wall at the peripheral shoulder, and wherein the two opposed faces of the locking tab incline towards one another.

5. The container of claim 1 wherein the base side wall has portions forming a depression to permit the insertion of a finger behind the clasped locking tab to facilitate unclasping of the container.

6. The container of claim 1 wherein the base side walls form a frustoconical surface and wherein the opposed faces of the locking tab are frustoconical surface segments and wherein the cover is joined to the base at a position opposite the locking tab by an integral hinge.

7. The container of claim 1 further comprising: a second locking tab attached by a second integral hinge to the cover on the side opposite the first locking tab, wherein the cover may be removably clasped to the base by rotating both locking tabs about their integral hinges to engage the two tabs between the rim wall and the side walls of the base.

8. The container of claim 7 wherein the cover has portions located between the two locking tabs which are not directly clasped to the base, wherein an increase of the pressure within the closed container beyond a desired amount will cause the unclasped portions to deflect upwardly to lift the peripheral shoulder and rim wall of the cover at selected portions of the container away from the peripheral shoulder and rim wall of the base to form an air passage between the cover and the base which will permit the venting of the interior high-pressure gases and a reduction of the interior pressure without disengagement of the locking tabs.

9. A thermoformed thermoplastic container comprising:

(a) a base with upwardly extending side walls and a peripheral shoulder extending outwardly from the side walls and a rim depending downwardly from the peripheral shoulder;

(b) a cover adapted to fit over and cover the base and having downwardly extending side walls adapted to snugly engage the rim wall of the base;

(c) a locking tab with two inclined spaced opposed faces and having a flange and attached at the flange by an integral hinge to the cover; and (d) a ledge formed on a wall of the base substantially parallel to the peripheral shoulder of the base and located a distance below the shoulder so as to engage and hold the locking tab inserted in an upwardly direction toward the peripheral shoulder to fit snugly between the side wall and the base rim with the flange of the tab engaged on the ledge so that the locking tab will remain attached to the base when the cover is in either an open or a closed position.

* * * * *